US010706807B2

(12) United States Patent
Lee

(10) Patent No.: US 10,706,807 B2
(45) Date of Patent: Jul. 7, 2020

(54) DISPLAY DEVICE AND DRIVING METHOD THEREOF

(71) Applicant: LG Display Co., Ltd., Seoul (KR)

(72) Inventor: Jaeseung Lee, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 49 days.

(21) Appl. No.: 15/351,637

(22) Filed: Nov. 15, 2016

(65) Prior Publication Data

US 2017/0154600 A1 Jun. 1, 2017

(30) Foreign Application Priority Data

Nov. 27, 2015 (KR) ..... 10-2015-0167809

(51) Int. Cl.
*G09G 3/36* (2006.01)
*G09G 3/20* (2006.01)

(52) U.S. Cl.
CPC ..... *G09G 3/3696* (2013.01); *G09G 3/2092* (2013.01); *G09G 3/3611* (2013.01); *G09G 2310/0289* (2013.01); *G09G 2310/08* (2013.01)

(58) Field of Classification Search
CPC ..... G09G 3/3696
See application file for complete search history.

(56) References Cited

U.S. PATENT DOCUMENTS 5,804,749 A * 9/1998 Shirakawa ..... G10H 7/002 84/601
2005/0231501 A1 10/2005 Nitawaki
2006/0007209 A1* 1/2006 Nakamura ..... G09G 3/3648 345/204
2009/0128215 A1* 5/2009 Hsueh ..... G09G 3/20 327/333
2013/0278790 A1* 10/2013 Oh ..... H04N 5/202 348/223.1
2014/0306948 A1* 10/2014 Iwamoto ..... G09G 3/3648 345/213
2016/0196795 A1* 7/2016 Kim ..... G09G 3/3648 345/211

FOREIGN PATENT DOCUMENTS

CN 1691125 A 11/2005
CN 101364390 A 2/2009

OTHER PUBLICATIONS

The First Office Action dated Dec. 5, 2018, from the State Intellectual Property Office of the People's Republic of China in counterpart Chinese application No. 201611055089.7.

* cited by examiner

*Primary Examiner* — Alexander Eisen
*Assistant Examiner* — Cory A Almeida
(74) *Attorney, Agent, or Firm* — Morgan, Lewis & Bockius LLP

(57) ABSTRACT

Provided is a display device including: a display panel; a system board configured to supply a signal and a voltage required to drive the display panel; a timing controller configured to receive the signal from the system board, generate control signals required to drive the display panel, and transmit some of the control signals to the system board; and a level shifter configured to convert voltage levels of the some signal of the timing controller into a signal voltage level suitable for the system board. The level shifter includes an output voltage control terminal configured to control the level shifter not to generate an output voltage when the system board is turned off.

9 Claims, 5 Drawing Sheets

DISPLAY DEVICE AND DRIVING METHOD THEREOF

CROSS-REFERENCE TO RELATED APPLICATIONS

This application claims the priority of Korean Patent Application No. 10-2015-0167809 filed on Nov. 27, 2015, in the Korean Intellectual Property Office, the disclosure of which is incorporated herein by reference.

BACKGROUND

Field

The present disclosure relates to a display device and a driving method thereof, and more particularly, to a display device in which a leakage current is generated when power supplied from a system board is turned off.

Description of the Related Art

With the development of the information society, various demands for display devices configured to display an image have been increasing. Accordingly, in recent years, various flat panel display (FPD) devices configured to reduce a weight and a volume of a cathode ray tube (CRT) have been developed and commercialized. Various FPD devices such as a liquid crystal display (LCD), a plasma display panel (PDP), and an organic light emitting diode (OLED) display device are being used.

An LCD of an active matrix driving type includes a thin film transistor (hereinafter, referred to as "TFT") as a switching element in each pixel. The LCD can be manufactured to be smaller than the CRT and thus may be applied to display units of portable information appliances, office equipment, computers, etc. Further, the LCD can be applied to televisions and thus is rapidly replacing the CRT.

A user's reliability in a display device becomes important. In particular, there have recently been cases where a leakage current is introduced into a system board of a display device and some functions of the display device cannot be performed.

FIG. 1 is a block diagram schematically showing a system board and a timing controller of a display device of the related art. Hereinafter, the display device of the related art will be described in detail with reference to the accompanying drawings.

Referring to FIG. 1, the display device includes a display panel (not shown), a system board 110, a level shifter 120, a timing controller 130, and a power supply unit 140.

The display panel may be a liquid crystal display panel configured to display an image using liquid crystals. The liquid crystal display panel includes a liquid crystal layer injected between two glass substrates bonded to each other with a space.

The system board 110 includes image data for displaying an image on the display panel, a clock signal for generating a signal required to drive the display panel, and an input voltage VIN. The image data and the clock signal are transmitted to the timing controller 130. The input voltage VIN is supplied to the power supply unit 140 at a level of 12 V.

The system board 110 includes a system sound processing unit 111 controlling sounds of the display device. The system sound processing unit 111 is driven in response to a signal transmitted from the timing controller 130.

The power supply unit 140 is supplied with the input voltage VIN from the system board 110 and generates a voltage required to drive a driving circuit such as the timing controller 130. Voltages relating to a driving of the timing controller 130 are a first voltage VCC1 and a second voltage VCC2. The first voltage VCC1 has a level of 2.5 V, and the second voltage VCC2 has a level of 1.2 V.

The timing controller 130 generates signals required to drive the display panel in response to a clock signal input from the system board 110. The signals of the timing controllers 130 include a gate driving signal GDC, a data driving signal DDC, a system sound control signal SSC, and a backlight driving control signal BDC. The signals of the timing controller 130 have levels of 2.5 V and 1.2 V. The system sound control signal SSC of the timing controller 130 is transmitted to the system board 110 under predetermined conditions and controls sounds of the display device 100. The system sound control signal SSC is one of signals generated by the timing controller 130 and has a level of 2.5 V.

Level shifters 120*a* and 120*b* are configured to convert the system sound control signal SSC and the backlight driving control signal BDC input from the timing controller 130 into proper voltage levels and then transmit them to the system board 110 and a backlight (not shown).

Referring to FIG. 1, the level shifters 120*a* and 120*b* include an enable pin Enable Pin connected to a ground GND. The enable pin Enable Pin is a terminal set to output an input signal as a signal SSC_out having a level of 3.3 V only when a voltage level of a signal SSC_in input into the level shifters 120*a* and 120*b* is in a low state.

FIG. 2 is an exemplary diagram showing level shifter waveforms and generation of leakage currents when the display device of the related art is turned off. FIG. 2 shows that when the input voltage VIN supplied from the system board 110 is turned from on to off, the input voltage VIN is not immediately and completely turned to an off state. This is because even if the input voltage VIN is turned off, a transmission line for transmitting the input voltage VIN has a high capacitance and thus a falling time of the input voltage VIN becomes long. The falling time is about 1000 ms. Therefore, even if the input voltage VIN is turned off, signals having certain voltage levels VCC1 and VCC2 are not disabled but remain in the timing controller 130.

Referring to FIG. 2, a voltage level of the signals remaining in the timing controller 130 is 2.5 V. This voltage level may be converted into 3.3 V and then transmitted to the system board 110. As a result, although the display device 100 is turned off, an unnecessary leakage current is introduced into the system board 110 and may cause a circuit damage or malfunction.

SUMMARY

Accordingly, the present invention is directed to a display device and a driving method thereof that substantially obviate one or more of the problems due to limitations and disadvantages of the related art.

An object of the present invention is to provide a display device to avoid an occurrence of circuit damage and malfunction of a system board in a liquid crystal display caused by an unnecessary leakage current introduced into the system board.

Additional features and advantages of the invention will be set forth in the description that follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a display device comprises a display panel; a system board configured to supply a signal and a voltage required to drive the display panel; a timing controller configured to receive the signal from the system board, generate control signals required to drive the display panel, and transmit some of the control signals to the system board; and a level shifter configured to convert voltage levels of the some signal of the timing controller into a signal voltage level suitable for the system board. The level shifter includes an output voltage control terminal configured to control the level shifter not to generate an output voltage when the system board is turned off.

In another aspect, a method for blocking a leakage current of a display device comprises turning off a system board; generating a signal from turn-off information of the system board; inputting some signals of a timing controller into a level shifter; inputting the signal generated from turn-off information into the level shifter; and disabling a voltage level shifting for the some signals of the timing controller by the level shifter.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION

Figure 1:
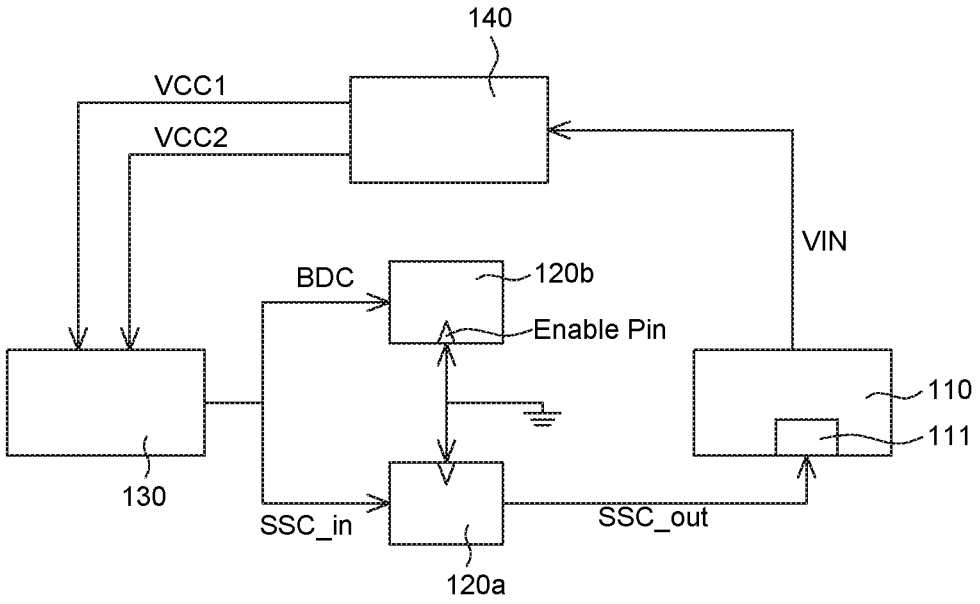
FIG. 1 is a plane view of a display device of the related art.
Figure 2:
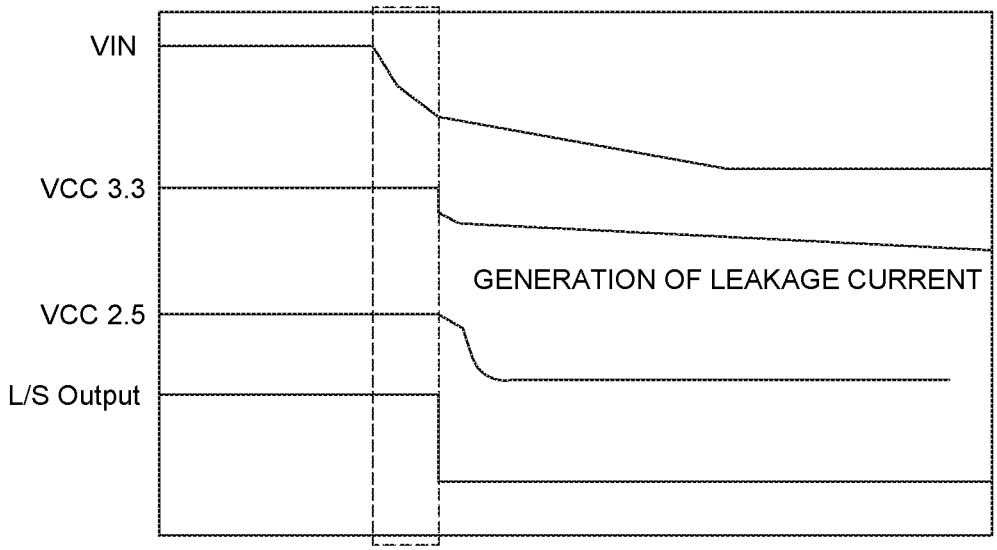
FIG. 2 is an exemplary diagram showing level shifter waveforms and generation of leakage currents when the display device of the related art is turned off.

Advantages and features of the present disclosure, and methods for accomplishing the same will be more clearly understood from exemplary embodiments described below with reference to the accompanying drawings. However, the present disclosure is not limited to the following exemplary embodiments but may be implemented in various different forms. The exemplary embodiments are provided only to complete disclosure of the present disclosure and to fully provide a person having ordinary skill in the art to which the present disclosure pertains with the category of the disclosure, and the present disclosure will be defined by the appended claims.

The shapes, sizes, ratios, angles, numbers, and the like illustrated in the accompanying drawings for describing the exemplary embodiments of the present disclosure are merely examples, and the present disclosure is not limited thereto. Like reference numerals generally denote like elements throughout the present specification. Further, in the following description, a detailed explanation of known related technologies may be omitted to avoid unnecessarily obscuring the subject matter of the present disclosure.

The terms such as "including," "having," and "consist of" used herein are generally intended to allow other components to be added unless the terms are used with the term "only". Any references to singular may include plural unless expressly stated otherwise.

Components are interpreted to include an ordinary error range even if not expressly stated.

When the position relation between two parts is described using the terms such as "on", "above", "below", and "next", one or more parts may be positioned between the two parts unless the terms are used with the term "immediately" or "directly" is not used.

When the time sequence between two or more incidents is described using the terms such as "after", "subsequent to", "next to", and "before", two or more incidents may be inconsecutive unless the terms are used with the term "immediately" or "directly".

Although the terms "first", "second", and the like are used for describing various components, these components are not confined by these terms. These terms are merely used for distinguishing one component from the other components. Therefore, a first component to be mentioned below may be a second component in a technical concept of the present disclosure.

Since size and thickness of each component illustrated in the drawings are represented for convenience in explanation, the present disclosure is not necessarily limited to the illustrated size and thickness of each component.

The features of various embodiments of the present disclosure can be partially or entirely bonded to or combined with each other and can be interlocked and operated in technically various ways, and the embodiments can be carried out independently of or in association with each other.

Hereinafter, an organic light emitting display device according to the exemplary embodiments of the present disclosure will be described in detail with reference to the accompanying drawings.

In the following, a liquid crystal display will be described as one example of the present disclosure for convenience in explanation. However, the present disclosure is not limited thereto. That is, the present disclosure may be applied to various display devices capable of supplying a scan signal through a gate line and displaying an image.

Figure 3:
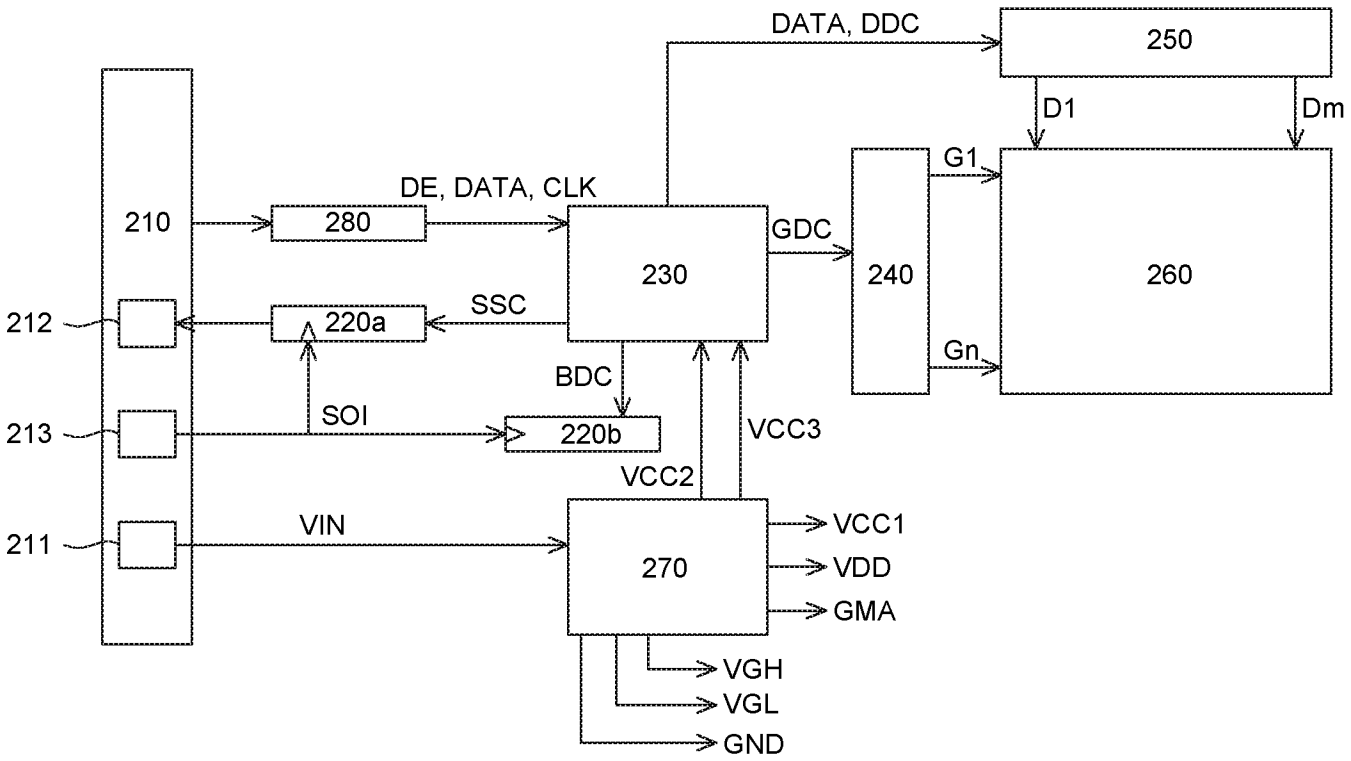
FIG. 3 is a block diagram illustrating a display device according to an exemplary embodiment of the present disclosure.

FIG. 3 is a plane view schematically illustrating a display device according to an exemplary embodiment of the present disclosure. Referring to FIG. 3, the display device of the present disclosure includes a system board 210, a first level shifter 220*a*, a second level shifter 220*b*, a timing controller 230, a gate driving circuit 240, a data driving circuit 250, a display panel 260, a power supply unit 270, and an interface 280.

The display panel 260 may be a liquid crystal display panel configured to display an image using liquid crystals. The liquid crystal display panel includes a liquid crystal layer injected between two glass substrates bonded to each other with a space.

Further, although not shown in the drawing, data lines D1 to Dm and gate lines G1 to Gn disposed on a lower glass substrate of the display panel 260 perpendicularly intersect with each other. TFTs disposed near the portion where the data lines D1 to Dm and the gate lines G1 to Gn intersect with each other are configured to supply data on the data lines D1 to Dm to liquid crystal cells Clc in response to scan signals from the gate lines G1 to Gn. In order to do so, gate electrodes of the TFTs are connected to the corresponding gate lines G1 to Gn, and source electrodes are connected to the corresponding data lines D1 to Dm. Further, drain electrodes of the TFTs are connected to pixel electrodes of the liquid crystal cells Clc.

Further, a black matrix layer, a color filter layer, and a common electrode are disposed on an upper glass substrate of the display panel 260. Furthermore, polarizers having optical axes orthogonal to each other are bonded onto the upper glass substrate and the lower glass substrate of the display panel 260. An alignment film for setting a pretilt angle of liquid crystals is disposed on an inner surface in contact with the liquid crystals. Also, a storage capacitor Cst is formed in each liquid crystal cell Clc of the display panel 260. The storage capacitor Cst may be formed between a pixel electrode of the liquid crystal cell Clc and a previous gate line or between a pixel electrode of the liquid crystal cell Clc and a non-illustrated common electrode line to maintain a uniform voltage of the liquid crystal cell Clc.

The data driving circuit 250 supplies a data voltage to the data lines D1 to Dm of the display panel 260. The data driving circuit 250 converts digital video data into an analog gamma voltage corresponding to a gray scale in response to a data control signal DDC from the timing controller 230 and then supplies the analog gamma voltage to the data lines D1 to Dm. The data driving circuit 250 uses a voltage VCC1 of 3.3 V as a power voltage.

The gate driving circuit 240 supplies a scan pulse to the gate lines G1 to Gn of the display panel 260. The gate driving circuit 240 sequentially supplies a scan pulse to the gate lines G1 to Gn in response to a gate control signal GDC from the timing controller 230 and selects a horizontal line of the display panel 260 to which data are supplied. A gate driver integrated circuit in which the gate driving circuits 240 are integrated is supplied with the voltage VCC1 of 3.3 V as a power voltage.

The timing controller 230 controls operation timings of the gate driving circuit 240 and the data driving circuit 250. The timing controller 230 generates the gate control signal GDC for controlling the gate driving circuit 240 and the data control signal DDC for controlling the data driving circuit 250 using vertical/horizontal synchronization signals and clock signals. The vertical/horizontal synchronization signals and clock signals are input from a graphic controller (not shown) of the system board 210 via the interface 280.

Herein, the gate control signal GDC includes a gate start pulse (GSP), a gate shift clock (GSC), a gate output enable (GOE), etc. The data control signal DDC includes a source start pulse (SSP), a source shift clock (SSC), a source output enable signal (SOC), a polarity signal (POL), etc. Further, the timing controller 230 realigns digital video data input from the graphic controller of the system board 210 via the interface 280 and then supplies the realigned data to the data driving circuit 250.

Further, a voltage input from the power supply unit 270 is supplied as a power voltage of a phase lock loop (PLL) provided within the timing controller 230. The phase lock loop (PLL) compares a clock signal input into the timing controller 230 with a reference frequency generated from an oscillator (not shown). Then, the phase lock loop (PLL) adjusts a frequency of the clock signal by a difference thereof and generates a clock signal for sampling digital video data.

Furthermore, the timing controller 230 is supplied from the power supply unit 270 with a voltage VCC2 of 2.5 V and a voltage VCC3 of 1.2 V as power voltages required for an operation of the timing controller 230.

The timing controller 230 generates a system sound control signal SSC and a backlight driving control signal BDC. The signals of the timing controller 230 have levels of 2.5 V and 1.2 V. The system sound control signal SSC of the timing controller 230 is converted into a specific signal level through the first level shifter 220*a*. Then, the system sound control signal SSC having the converted level is transmitted to the system board 210 and controls sounds of the display device 200. The system sound control signal SSC is one of signals generated by the timing controller 230 and has a level of 2.5 V. The system sound control signal SSC to be input into the system 210 has a level of 3.3 V.

The backlight driving control signal BDC of the timing controller 230 is converted into a specific signal level through the second level shifter 220*b*. Herein, the backlight driving control signal BDC having the converted level will be involved in a driving of a backlight (not shown).

The interface 280 may include a low voltage differential signaling (LVDS) receiver. The interface 280 reduces voltage levels and increases frequencies of signals input from the graphic controller of the system board 210 using the LVDS receiver, thereby reducing the number of necessary signal lines between the system board 210 and the timing controller 230.

To reduce electromagnetic interference (hereinafter, referred to as "EMI") caused by a high-frequency component and a high voltage of a signal supplied to the timing controller 230 from the interface 280, an EMI filter (not shown) is provided between the interface 280 and the timing controller 230.

The power supply unit 270 generates a data voltage of the display panel 260, on/off voltages VGH and VGL of the TFT, power voltages VCC of the driving circuits and the timing controller 230, etc.

The power supply unit 270 is supplied with an input voltage VIN from the system board 210. The power supply unit 270 generates the voltages VCC2 and VCC3 required to drive the timing controller 230 by reducing or increasing a voltage based on the input voltage VIN and transmits the voltages VCC2 and VCC3 to the timing controller 230. Further, the power supply unit 270 generates and supplies a gate low voltage VGL, a gate high voltage VGH, and a power voltage VCC1 of 3.3 V required for an operation of the gate driving circuit 240. Then, the power supply unit 270 generates and supplies a power voltage VCC1 of 3.3 V and a data high voltage VDD involved in a driving of the data driving circuit 250 and an analog gamma voltage GMA converted from digital video data and corresponding to a gray scale.

Referring to FIG. 3, the system board 210 according to an exemplary embodiment of the present disclosure includes the graphic controller (not shown), an external power input unit 211, a system sound processing unit 212, and a power-off information transmitting unit 213.

The graphic controller (not shown) of the system board 210 has an image processing function of transmitting vertical/horizontal synchronization signals, clock signals, and data to the timing controller 230 through a low voltage differential signaling (LVDS) transmitter of the interface 280. The external power input unit 211 supplies the input voltage VIN to the power supply unit 270. For example, the input voltage VIN may be 12 V.

The system sound processing unit 212 is involved in generation of sounds of the system. Signals generated from the timing controller 230 are used to drive the display panel 260. Also, some of the signals are transmitted to the system sound processing unit 212 of the system board 210 and then used to execute sounds of the system. The system sound control signal SSC to be transmitted from the timing controller 230 to the system board 210 has a level of 2.5 V when being generated by the timing controller 230. Then, the system sound control signal SSC is converted to have a level of 3.3 V and then input into the system board 210.

The power-off information transmitting unit 213 according to an exemplary embodiment of the present disclosure transmits an off state in the form of a signal to the level shifters 220*a* and 220*b* when transmission of the input voltage VIN supplied from the external power input unit 211 to the power supply unit 270 is stopped to turn off the display panel 260 by the system board 210. This signal is a system-off information SOI having a certain voltage level.

The power-off information transmitting unit 213 may be connected to the external power input unit 211 by a control switch circuit (not shown). For example, if the input voltage VIN from the external power input unit 211 is turned off by the control switch circuit, the system-off information SOI generated by the power-off information transmitting unit 213 is simultaneously turned on by the control switch circuit and then transmitted to the level shifters 220*a* and 220*b*. As a result, the system sound control signal SSC of the timing controller 230 input into the level shifter 220*a* is not output from the level shifter 220*a* as a voltage level for operating the system sound processing unit 212.

The level shifters 220*a* and 220*b* are configured to shift an input voltage level to a specific voltage level according to a preset function of the level shifters 220*a* and 220*b* and then output the voltage level. Referring to FIG. 3, the level shifters 220*a* and 220*b* according to an exemplary embodiment of the present disclosure includes an enable pin Enable Pin. The enable pin Enable Pin is configured to receive an off state in the form of the system-off information SOI having a certain voltage level when transmission of the input voltage VIN supplied from the external power input unit 211 to the power supply unit 270 is stopped. The enable pin Enable Pin disables the system sound control signal SSC of the timing controller 230 input into the level shifter 220*a* not to be output from the level shifter 220*a* as a voltage level for operating the system sound processing unit 212. Therefore, the enable pin Enable Pin functions as an output voltage control terminal of the level shifter 220*a*.

In a display device of the related art, even if a supply of an input voltage VIN from an external power input unit to a power supply unit is stopped, some signals of a timing controller are input into a level shifter. Then, a signal having a voltage level sufficient to operate a system sound processing unit is generated. This voltage level signal is introduced into a system board, and, thus, a leakage current is generated. The leakage current may cause a malfunction of the display device. However, in the display device 200 according to an exemplary embodiment of the present disclosure, a leakage current is not generated in an off state of the display device 200 due to the system-off information SOI input into the enable pin Enable Pin of the level shifter 220*a*. Therefore, the reliability of the display device 200 can be improved.

Figure 4:
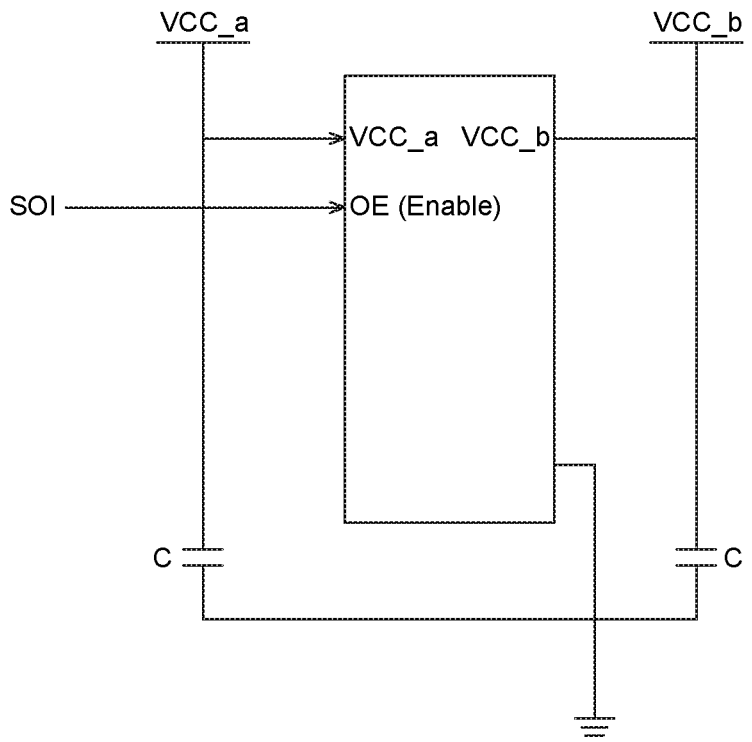
FIG. 4 is an exemplary diagram schematically illustrating a level shifter according to an exemplary embodiment of the present disclosure.

FIG. 4 is an exemplary diagram schematically illustrating a level shifter according to an exemplary embodiment of the present disclosure. Referring to FIG. 4, the level shifter functions to receive a signal VCC-a having a voltage level of 2.5 V and involved in a driving of the timing controller 230 and output a signal VCC-b having a voltage level of 3.3 V. Further, the level shifter includes an enable terminal Enable configured to disable whether or not to output the signal VCC-b having a voltage level of 3.3 V shifted from the signal VCC-a having a voltage level of 2.5 V of the timing controller 230.

Upon receipt of the signal SOI indicative of an off state of the input voltage VIN in the system board 210, the enable terminal Enable disables the level shifter not to shift the signal VCC-a having a voltage level of 2.5 V to the signal VCC-b having a voltage level of 3.3 V.

Figure 5:
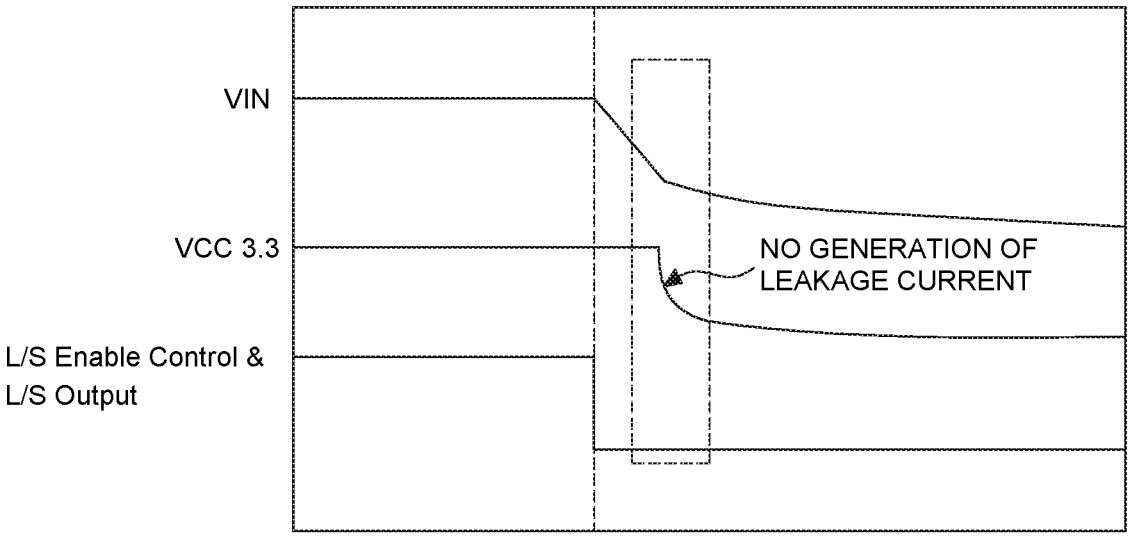
FIG. 5 is an exemplary diagram showing level shifter waveforms when a display device is turned off according to an exemplary embodiment of the present disclosure.

FIG. 5 is an exemplary diagram showing level shifter waveforms when a display device is turned off according to an exemplary embodiment of the present disclosure. FIG. 5 shows that when the input voltage VIN supplied from the system board 210 is turned from on to off, the input voltage VIN is not immediately and completely turned to an off state. This is because even if the input voltage VIN is turned off, a transmission line for transmitting the input voltage VIN has a high capacitance and thus a falling time of the input voltage VIN becomes long. The falling time is about 1000 ms. Therefore, even if the input voltage VIN is turned off, a signal having a certain voltage level VCC 2.5 is not disabled but remains in the timing controller 230. FIG. 5 according to an exemplary embodiment of the present disclosure shows that the remaining voltage level of 2.5 V VCC 2.5 is disabled not to be output by the level shifter after the SOI is input into the enable terminal Enable of the level shifter.

The exemplary embodiments of the present disclosure can also be described as follows:

According to an aspect of the present disclosure, a display device comprises a display panel; a system board configured to supply a signal and a voltage required for an operation of the display panel; a timing controller configured to receive the signal from the system board, generate control signals required to drive the display panel, and transmit some of the control signals to the system board; and a level shifter configured to convert voltage levels of the some signal of the timing controller into a signal voltage level suitable for the system board. The level shifter includes an output voltage control terminal configured to control the level shifter not to generate an output voltage when the system board is turned off.

The system board may include a system sound processing unit implemented by a signal input from the timing controller.

The system sound processing unit may receive a voltage level shifted by the level shifter with respect to the some signals of the timing controller.

The some signals of the timing controller may have a voltage level of 2.5 V.

The shifted voltage level may be 3.3 V.

The display device may further comprise a power supply unit configured to receive an input voltage from the system board and generate a voltage for driving the timing controller.

The power supply unit may transmit driving voltages of 2.5 V and 1.2 V to the timing controller.

The system board may include an external power supply unit configured to supply the input voltage to the power supply unit.

The system board may include a system-off information generation unit configured to transmit a system-off information to the level shifter when the input voltage of the external power supply unit is turned off.

The system-off information may be input into the output voltage control terminal of the level shifter.

According to an aspect of the present disclosure, a method for blocking a leakage current of a display device comprises turning off a system board; generating a signal from turn-off information of the system board; inputting some signals of a timing controller into a level shifter; inputting the signal generated from turn-off information into the level shifter; and disabling a voltage level shifting for the some signals of the timing controller by the level shifter.

The method may further comprise receiving power from the system board and generating a driving voltage of the timing controller.

The turn-off information may be input into an enable terminal of the level shifter.

According to exemplary embodiments of the present disclosure, a level shifter of a display device may receive a signal indicative of an off state of a system board when the system board is turned off, and then disable an output from the level shifter. As a result, a signal transmitted from a timing controller to the system board is not generated. Thus, a leakage current to be introduced into the system board is blocked. Therefore, it is possible to protect a system circuit and suppress a malfunction.

It will be apparent to those skilled in the art that various modifications and variations can be made in the display device and driving method thereof of the present invention without departing from the spirit or scope of the invention. Thus, it is intended that the present invention cover the modifications and variations of this invention provided they come within the scope of the appended claims and their equivalents.

What is claimed is:

1. A display device, comprising:

a display panel;

a system board connected to the display panel and including an external power input part and a power-off information transmitting part, and configured to supply a signal to the display panel and an input voltage to a power supply;

a timing controller connected between the display panel and the system board, and configured to receive the signal from the system board, generate control signals required to drive the display panel, and transmit some of the control signals to the system board; and a level shifter connected between the timing controller and the system board, and configured to convert voltage levels of the some signal of the timing controller into a signal voltage level suitable for the system board, wherein when transmission of the input voltage supplied from the external power input part of the system board to the power supply is stopped to turn off the display panel by the system board, the power-off information transmitting part of the system board transmits an off state in a form of a signal to the level shifter, wherein the power-off information transmitting part is connected to the external power input part by a control switch circuit, and when the input voltage is turned off by the control switch circuit, a system-off information generated by the power-off information transmitting part is simultaneously turned on by the control switch circuit and then transmitted to the level shifter and wherein the level shifter includes an output voltage control terminal configured to control the level shifter not to generate any output voltage level suitable for the system board when the system-off information is transmitted to the level shifter.

2. The display device of claim 1, wherein the system board receives a voltage level shifted by the level shifter with respect to the some signals of the timing controller.

3. The display device of claim 2, wherein the some signals of the timing controller have a voltage level of 2.5 V.

4. The display device of claim 2, wherein the shifted voltage level is 3.3 V.

5. The display device of claim 1, wherein the power supply is configured to receive the input voltage from the system board and generate a voltage for driving the timing controller.

6. The display device of claim 5, wherein the power supply unit transmits driving voltages of 2.5 V and 1.2 V to the timing controller.

7. A method for blocking a leakage current of a display device, comprising:

providing a system board including an external power input part and a power-off information transmitting part;

connecting the power-off information transmitting part of the system board to the external power input part of the system board by a control switch circuit;

turning off an input voltage by the control switch circuit and stopping transmission of the input voltage to a power supply, and simultaneously turning on a system-off information of the system board by the control switch circuit;

transmitting the system-off information to a level shifter connected between a timing controller and the system board; and controlling an output voltage control terminal of the level shifter not to generate any output voltage level suitable for the system board.

8. The method of claim 7, further comprising:

receiving power from the system board and generating a driving voltage of the timing controller.

9. The method of claim 7, wherein the system-off information is input into an enable terminal of the level shifter.

* * * * *